US006390290B1

(12) United States Patent
Focke et al.

(10) Patent No.: US 6,390,290 B1
(45) Date of Patent: May 21, 2002

(54) FOLDABLE MATERIAL (CIGARETTE) PACKAGING

(75) Inventors: Heinz Focke, Verden; Henry Buse, Visselhövede, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/600,979

(22) PCT Filed: Jan. 1, 1999

(86) PCT No.: PCT/EP99/00042

§ 371 Date: Jul. 25, 2000

§ 102(e) Date: Jul. 25, 2000

(87) PCT Pub. No.: WO99/37559

PCT Pub. Date: Jul. 29, 1999

(30) Foreign Application Priority Data

Dec. 6, 1998 (DE) ..... 198 02 800

(51) Int. Cl.[7] ..... B65D 85/10

(52) U.S. Cl. ..... 206/27; 206/206; 206/242; 206/273; 206/229; 206/87.13

(58) Field of Search ..... 206/271, 273, 206/259, 242; 229/87.13, 184, 137, 160.1

(56) References Cited

U.S. PATENT DOCUMENTS

| | | | | | |
|---|---|---|---|---|---|
| 1,967,204 | A | * | 7/1934 | Genz | 206/271 |
| 2,026,477 | A | | 12/1935 | Lescher | |
| 3,301,468 | A | * | 1/1967 | Staley | 229/87.13 |
| 4,121,713 | A | * | 10/1978 | Focke et al. | 206/274 |
| 4,508,218 | A | | 4/1985 | Focke et al. | |
| 5,301,804 | A | * | 4/1994 | Focke et al. | 206/271 |
| 5,762,186 | A | * | 6/1998 | Focke et al. | 206/245 |

FOREIGN PATENT DOCUMENTS

| | | |
|---|---|---|
| DE | 634802 | 8/1936 |
| DE | 43 28 97 | 6/1993 |
| EP | 649 797 | 4/1995 |
| EP | 745 540 | 6/1995 |

* cited by examiner

*Primary Examiner*—Mickey Yu
*Assistant Examiner*—Jila M. Mohandesi
(74) *Attorney, Agent, or Firm*—Sughrue Mion, PLLC

(57) ABSTRACT

A soft-carton-type cigarette pack made from a one-piece blank of paper or the like. A base wall is reinforced by a double-layered design of base tabs and, in addition, is provided with a reinforcing strip which runs around the inside. An opening aid is provided, in interaction with a Z-fold, in the region of an end wall. An exposed grip tab can be gripped for the purpose of removing a tear-open flap, bounded by perforation lines, in the region of the end wall.

14 Claims, 11 Drawing Sheets

Figure 1:
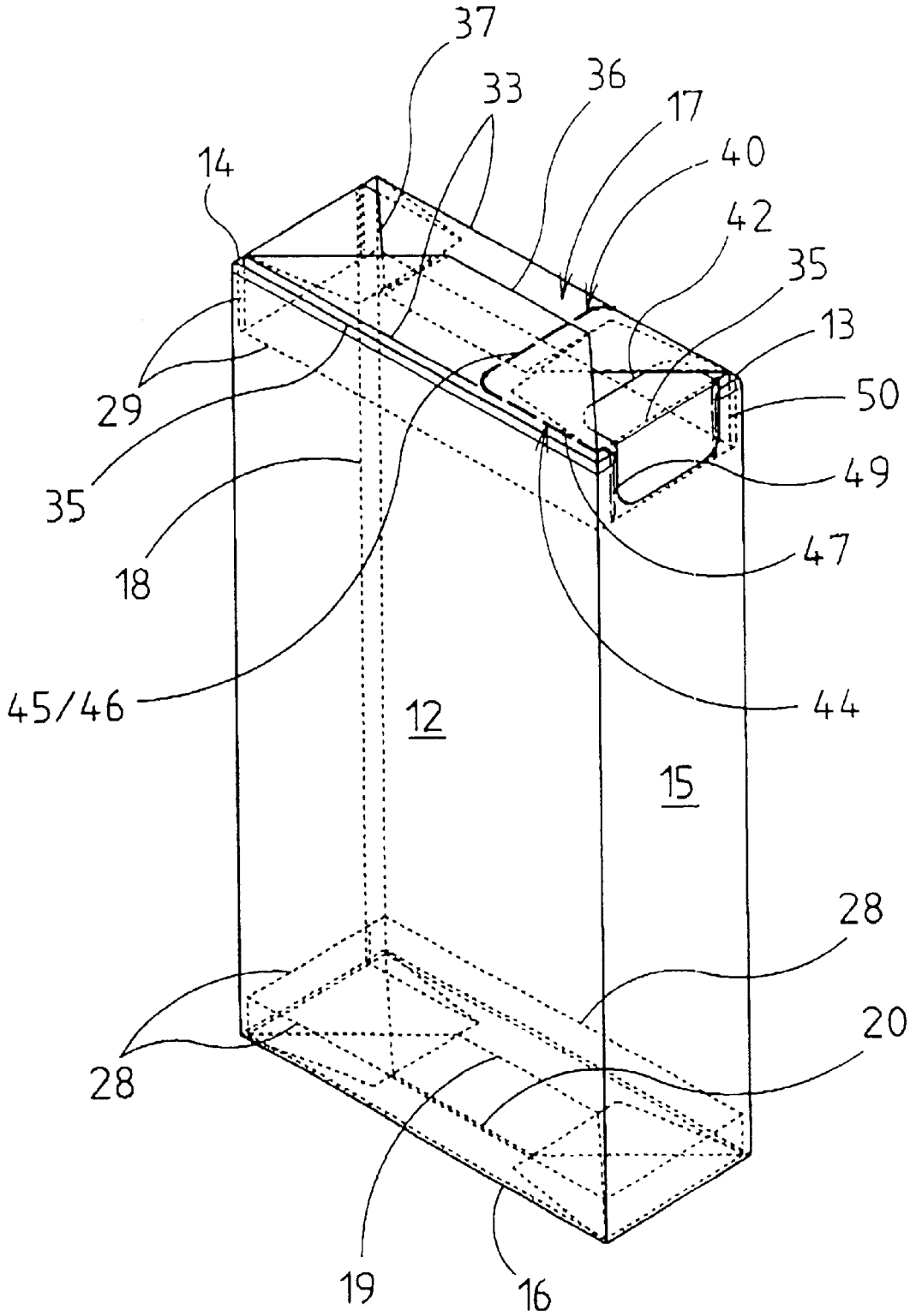

Fig.3
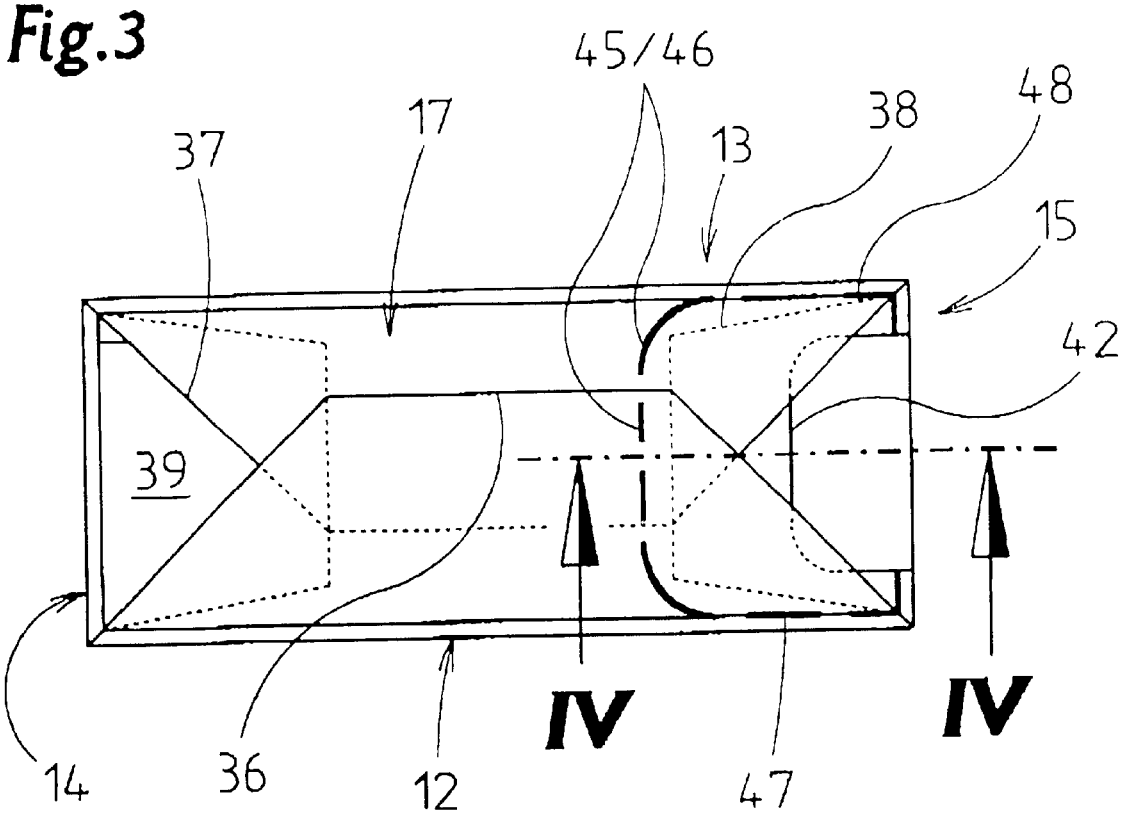
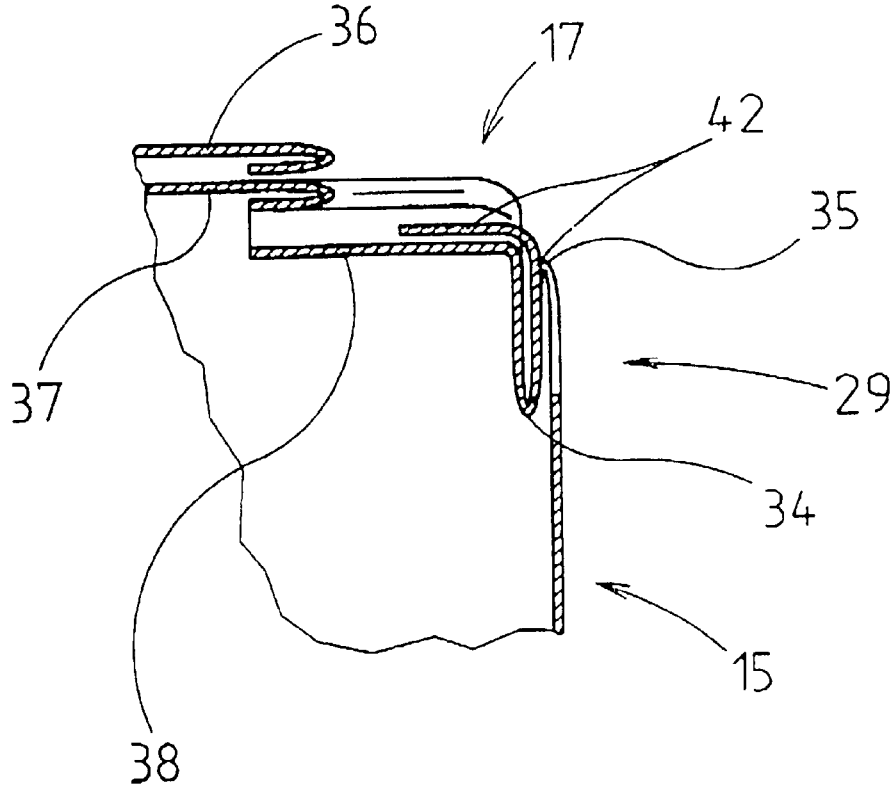
Fig.4

10
41
42
17
37
36
56
40
38
43
15
12

10
41
38
42
17
37
36
56
40
43
15
12

42
35
29
32
15(12,13)
24
36,37
31
34
11
28
25
26

34
35
46
48
44
45
47
37
38
36
39
18
13
15
12
14
19
21
20
22
29
42
28
27
26

FOLDABLE MATERIAL (CIGARETTE) PACKAGING

DESCRIPTION

The invention relates to a pack made of foldable packaging material, in particular cuboid-shaped (cigarette) pack made of paper, paperboard or similar packaging material, comprising a front wall, rear wall, side walls as well as base wall and end wall, with the end wall being delimited from adjacent walls by a free border edge or folding edge.

The invention is concerned primarily with cigarette packs of the soft-pack or soft-carton-pack type, in particular to further developments of, and improvements to, cigarette packs according to U.S. Pat. No. 4,508,218 and EP 0,649, 797. The special feature of the aforementioned cigarette packs is that they (may) consist of a single blank. In this case, according to one embodiment, a part of the pack with a front wall, rear wall and side walls, this part being referred to as the carton, is separated off from an end wall by a Z-shaped fold. This design of the soft (-carton) pack makes it possible to dispense with an otherwise conventional inner wrapper made of tin foil or paper.

The invention is concerned primarily with an opening aid for packs of the type introduced above. One such pack which is known is one for "cheroots", which is shaped like a pouch and has a strip-like tear-off flap. This is folded such that a gripping end of the tear-off flap projects laterally into the region of and above the end wall. When the tear-off flap is gripped, an upper partial region of a narrow, upright side wall is detached along perforation lines, forming a side opening for gripping the "cheroots". Due to the pouch-like design, the end wall of this type of pack is open or covered by an outer wrapper of film, which must be removed separately.

The object of the invention is to design the pack introduced above in such a way that facilitates opening of the pack when it is used for the first time, even if the end wall is closed.

To achieve this object, the pack according to the invention is characterized by the following features:

a) a tear-off flap is formed in the region of the end wall, b) the tear-off flap is bounded by a weakened line or a perforation line, c) the tear-off flap has a grip tab for separating the tear-off flap from the end wall, d) in the unopened pack, the grip tab projects over the border edge or folding edge of the end wall as part of the tear-off flap.

The freely projecting flap arranged in the manner of the invention may be detached by hand, the opening flap or a grip tab being part of a tear-open flap defined by perforations or other weakening lines. Said tear-open flap is removed with the aid of the grip tab so as form a removal opening for the pack contents, that is to say for the cigarettes The opening flap can be used, in particular, in the case of (cigarette) packs in which a Z-fold is formed adjacent to the end wall. The opening flap is formed by punched lines of the blank such that, when the Z-fold is produced, the grip tab is not folded along therewith, as a continuation of a leg of the Z-fold, and thus passes into a position which is favourable for use.

A cigarette pack of optimum design is formed in accordance with EP 0 649 797 and is provided with an opening aid according to the invention in the region of the end wall. In this case, the opening flap is provided in the region of a narrow side wall, with the result that a sub-region of the end wall can be removed with the aid of the tear-open flap.

Further features relate to the configuration of the (cigarette) pack in the region of a base wall and of the end wall of the same, in particular in terms of the design of reinforcements of the base wall and of the configuration of the folding tab.

Figure 2:
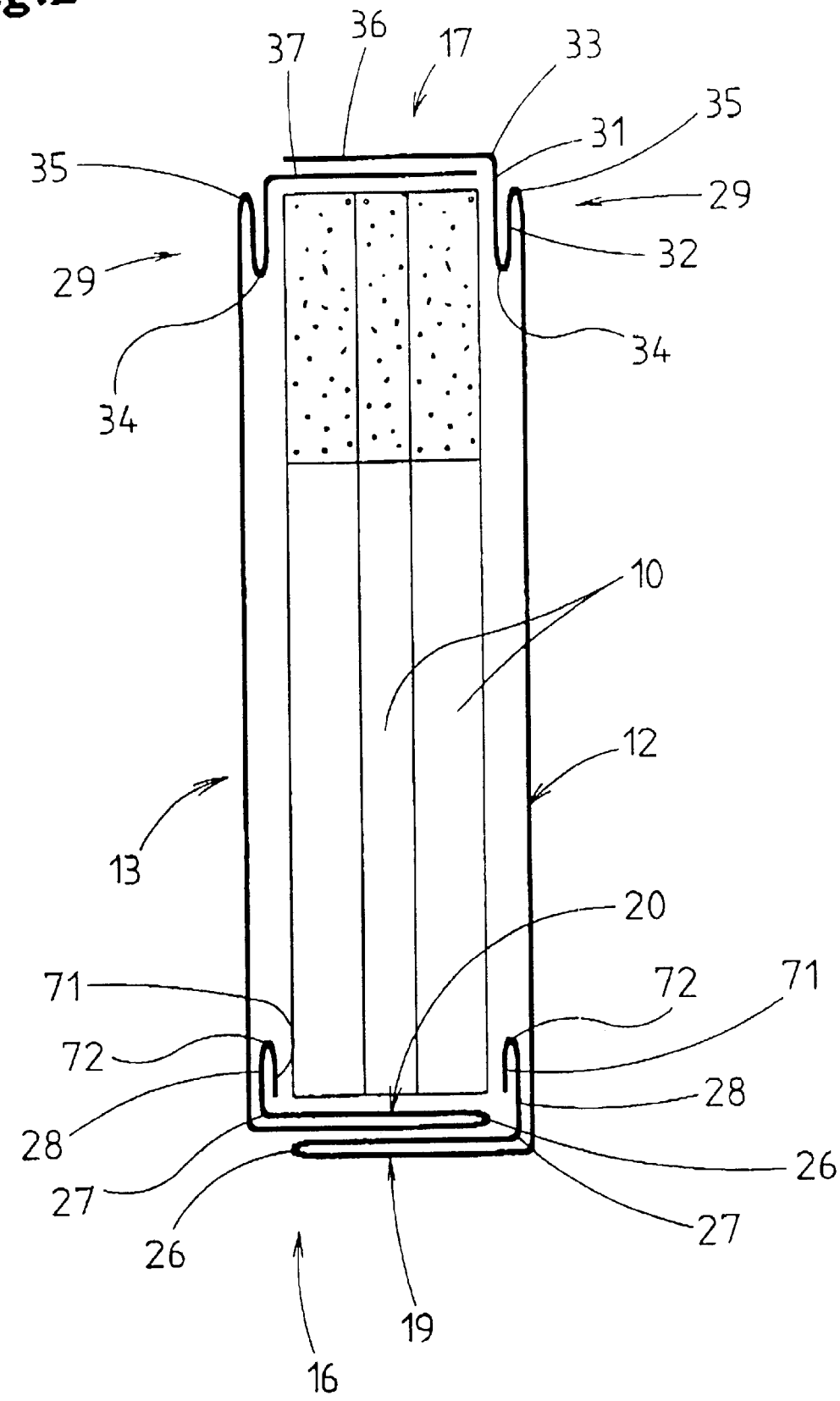
Figure 5:
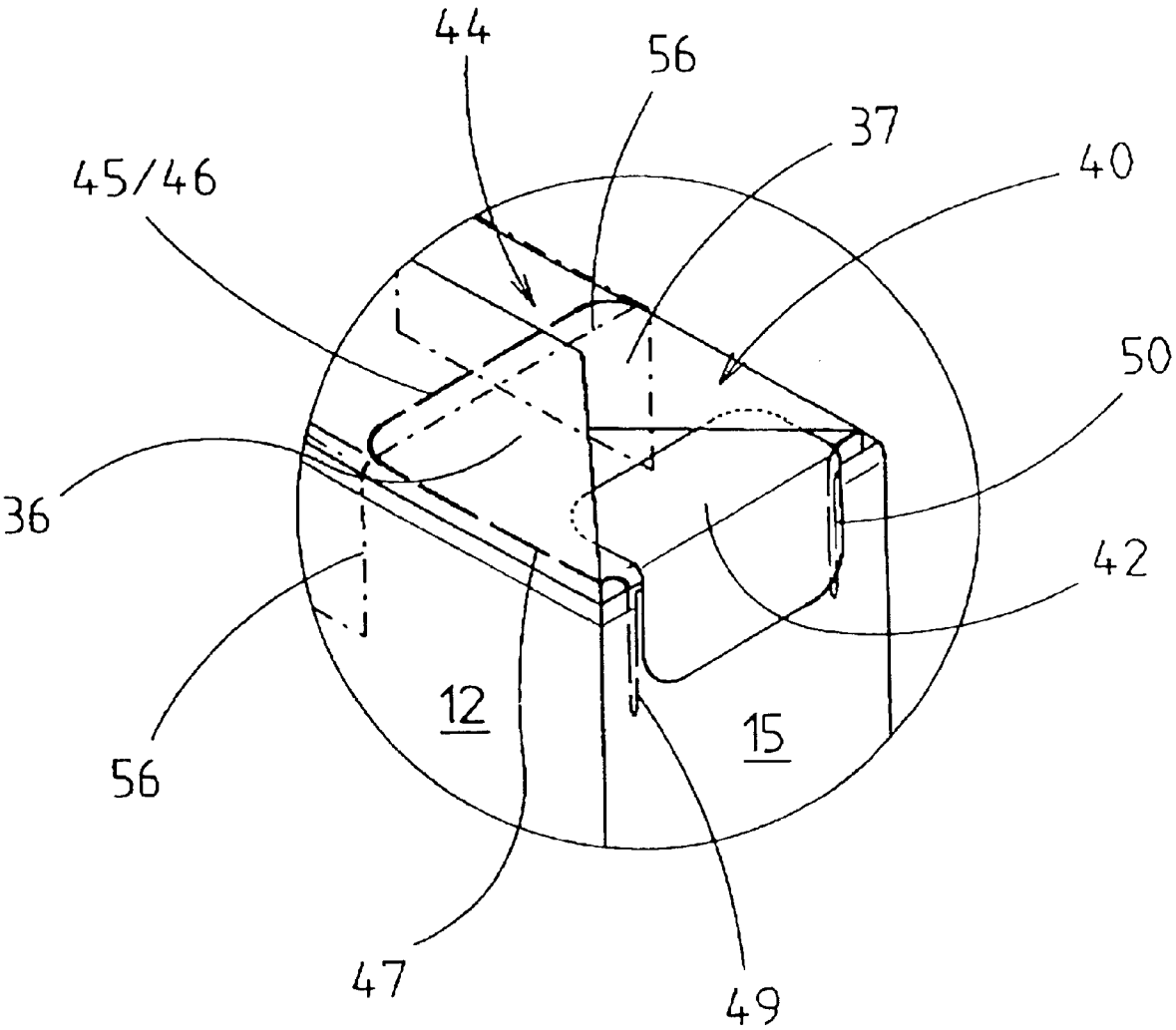
Figures 6, 7:
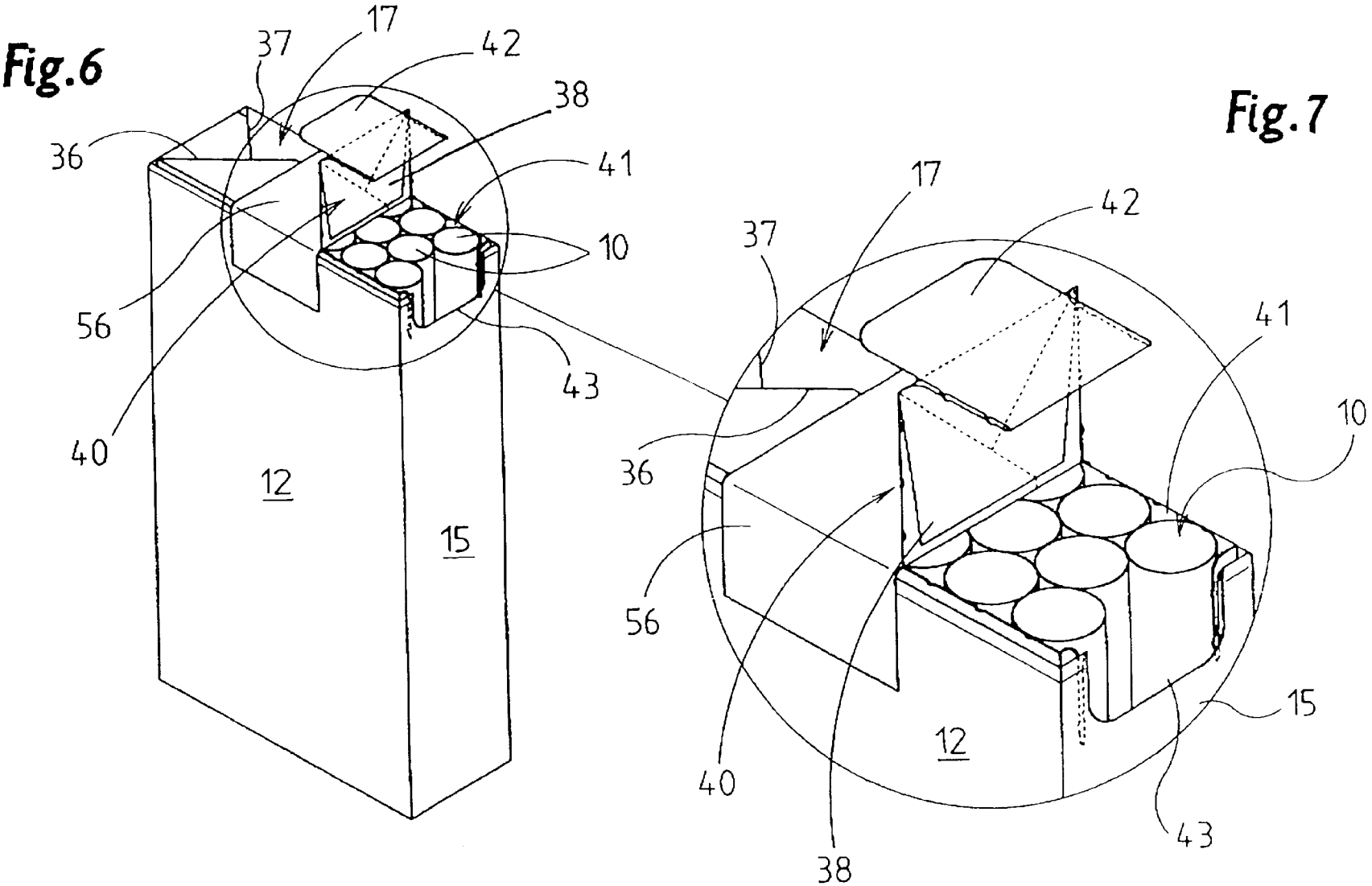
Figure 8:
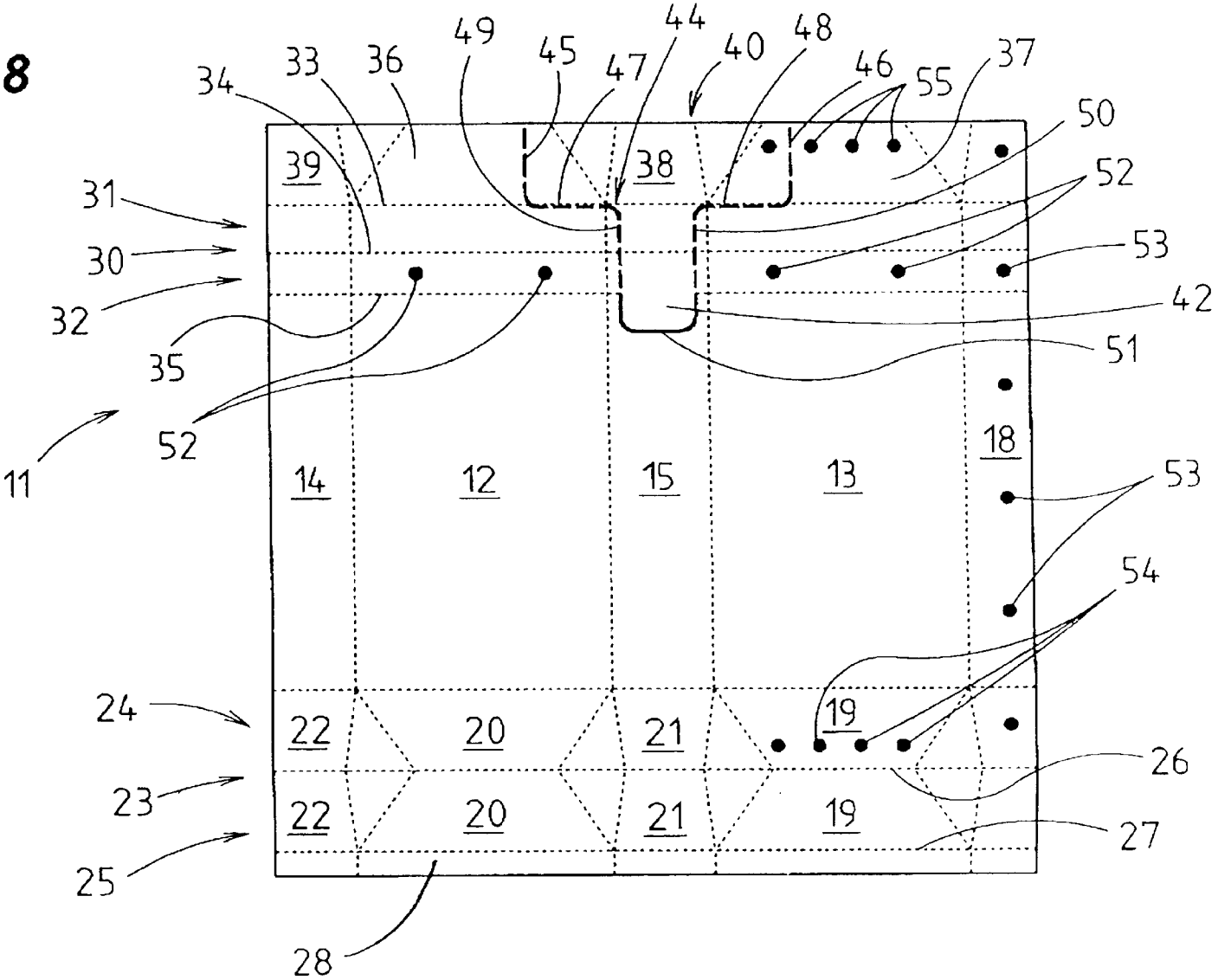
Figure 10:
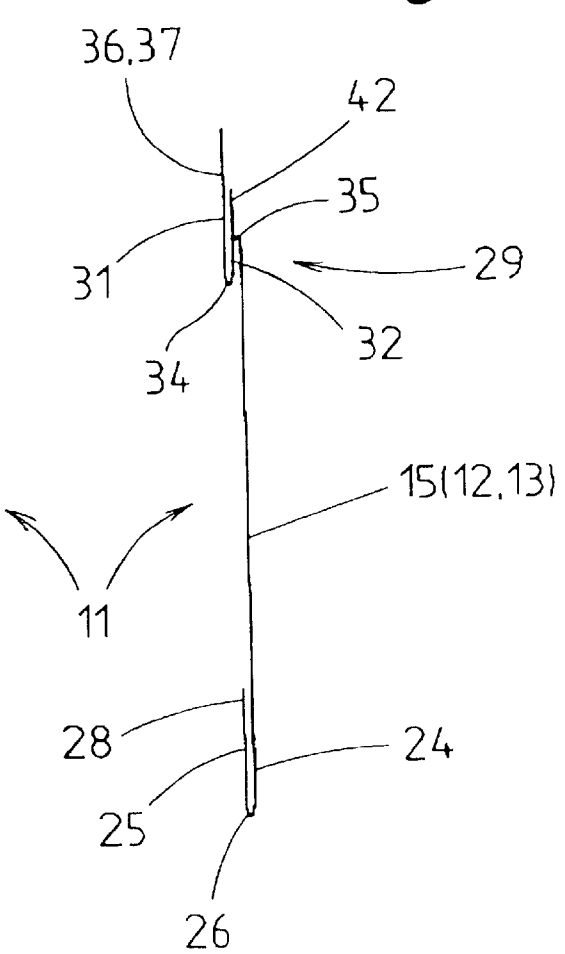
Figure 9:
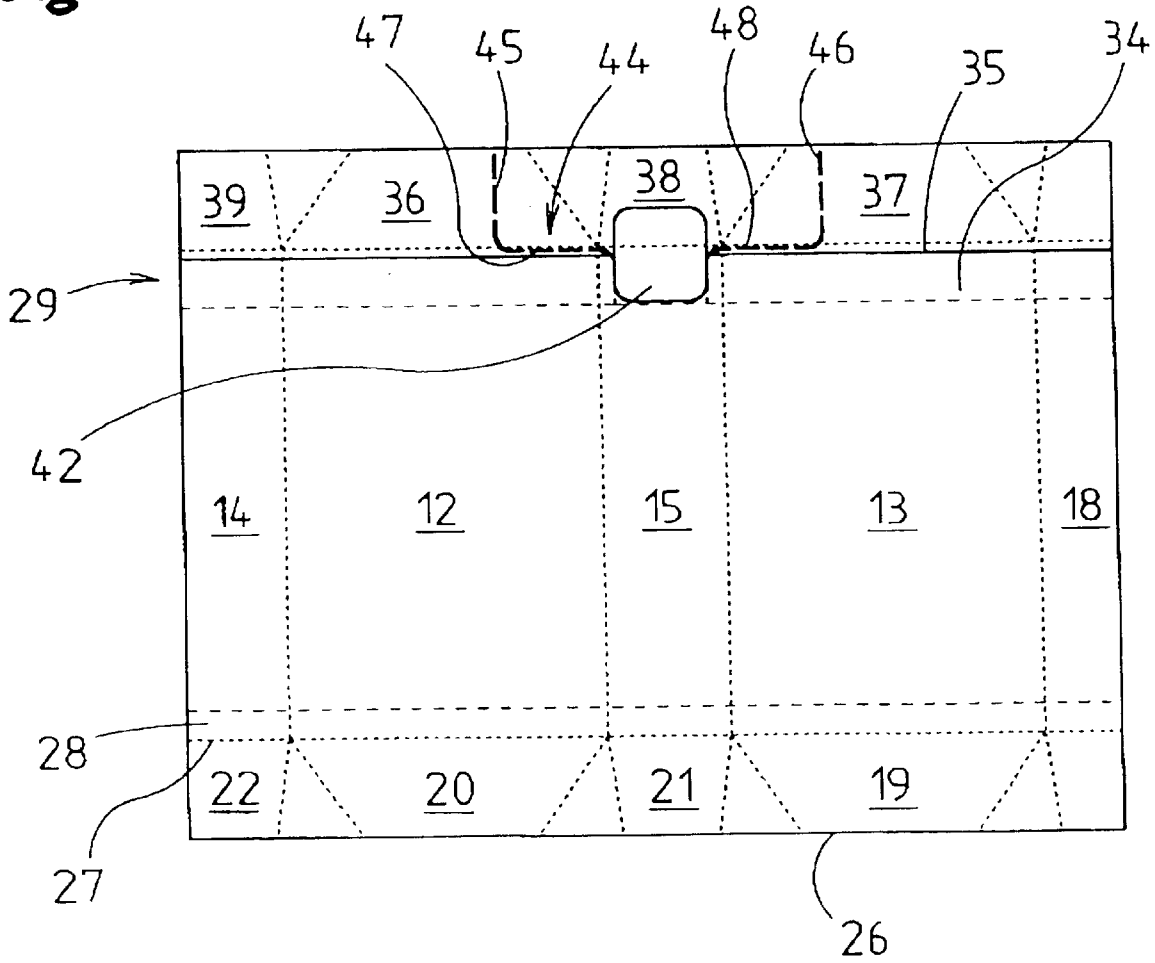
Figure 11:
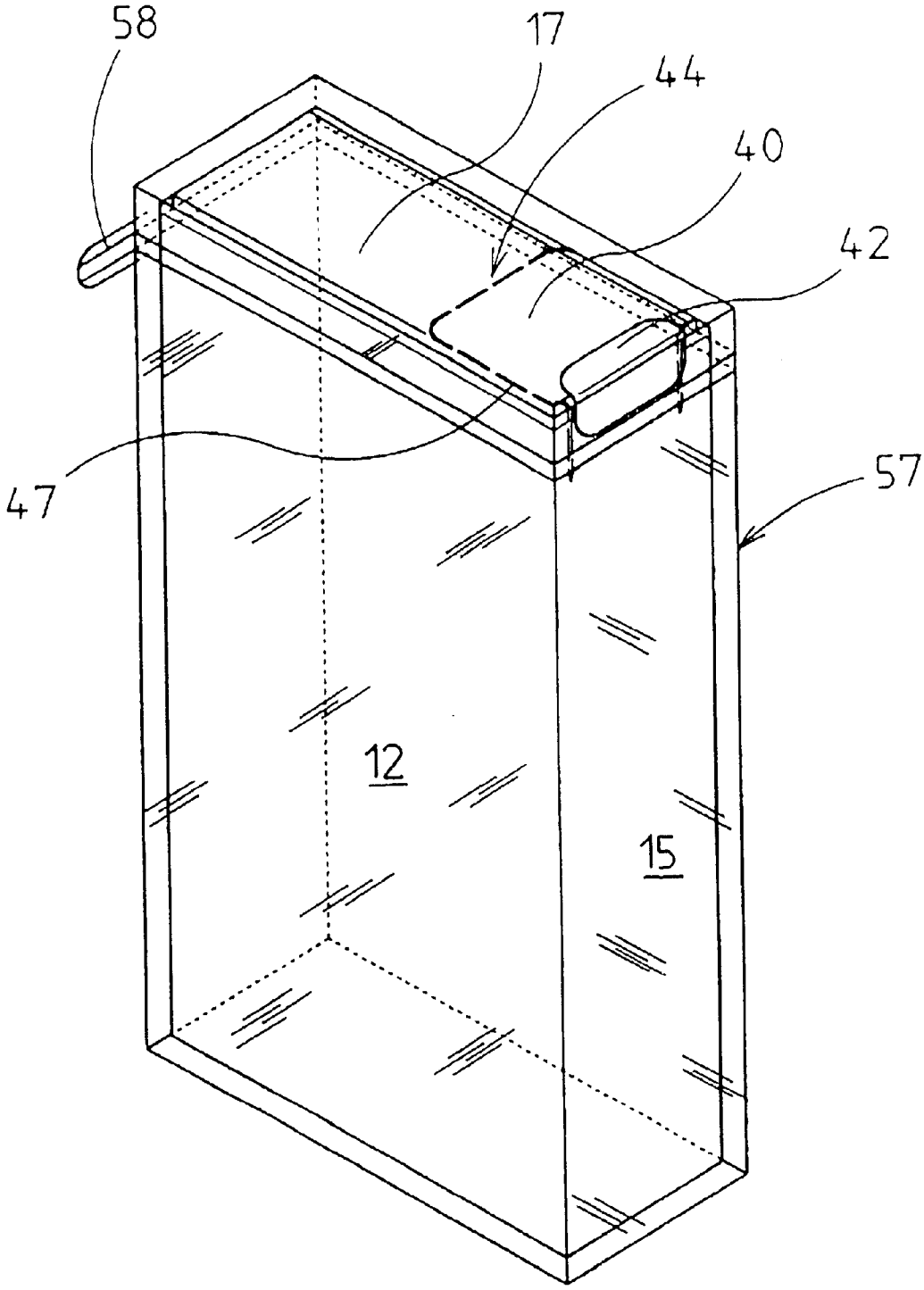
Figure 12:
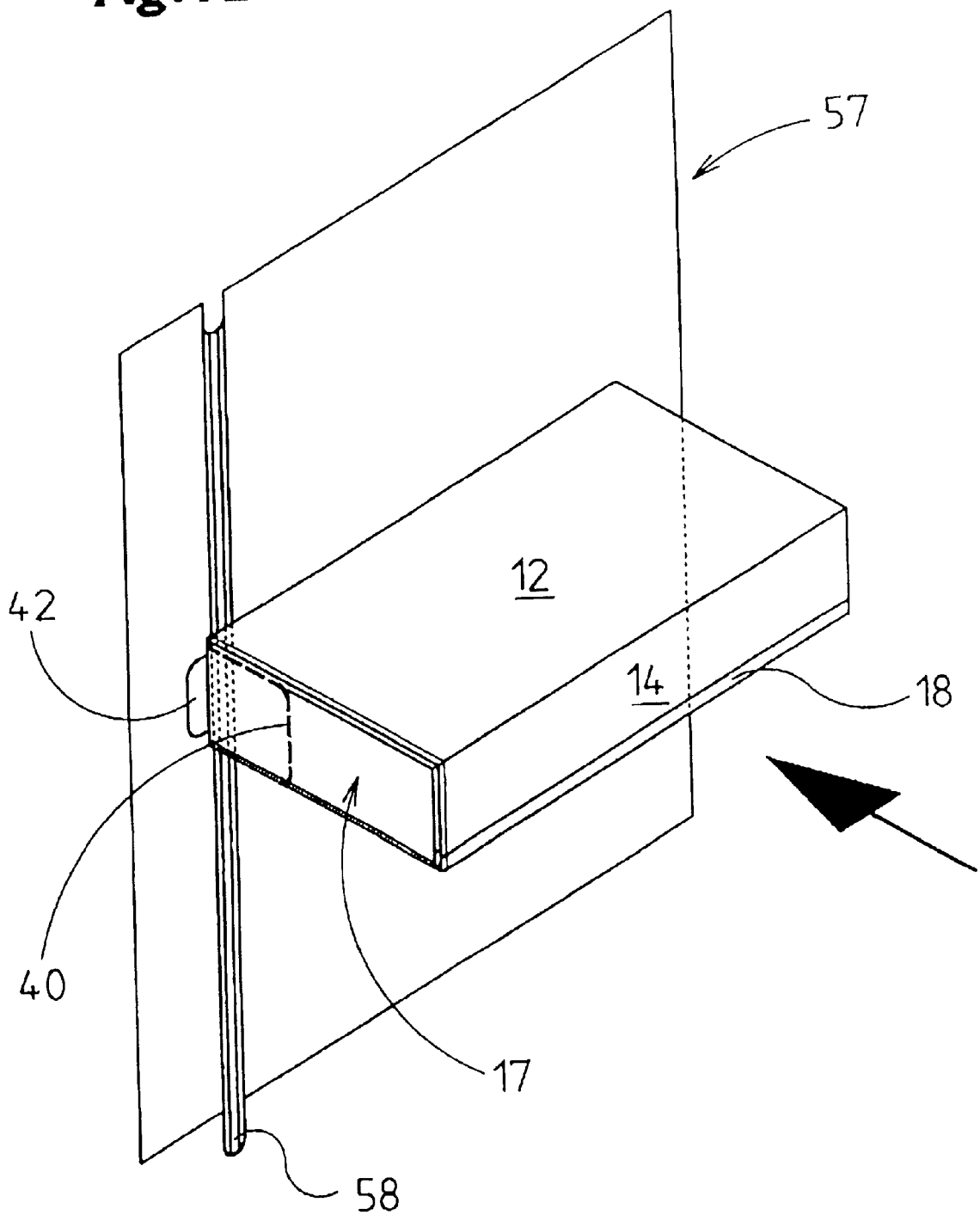
Figure 13:
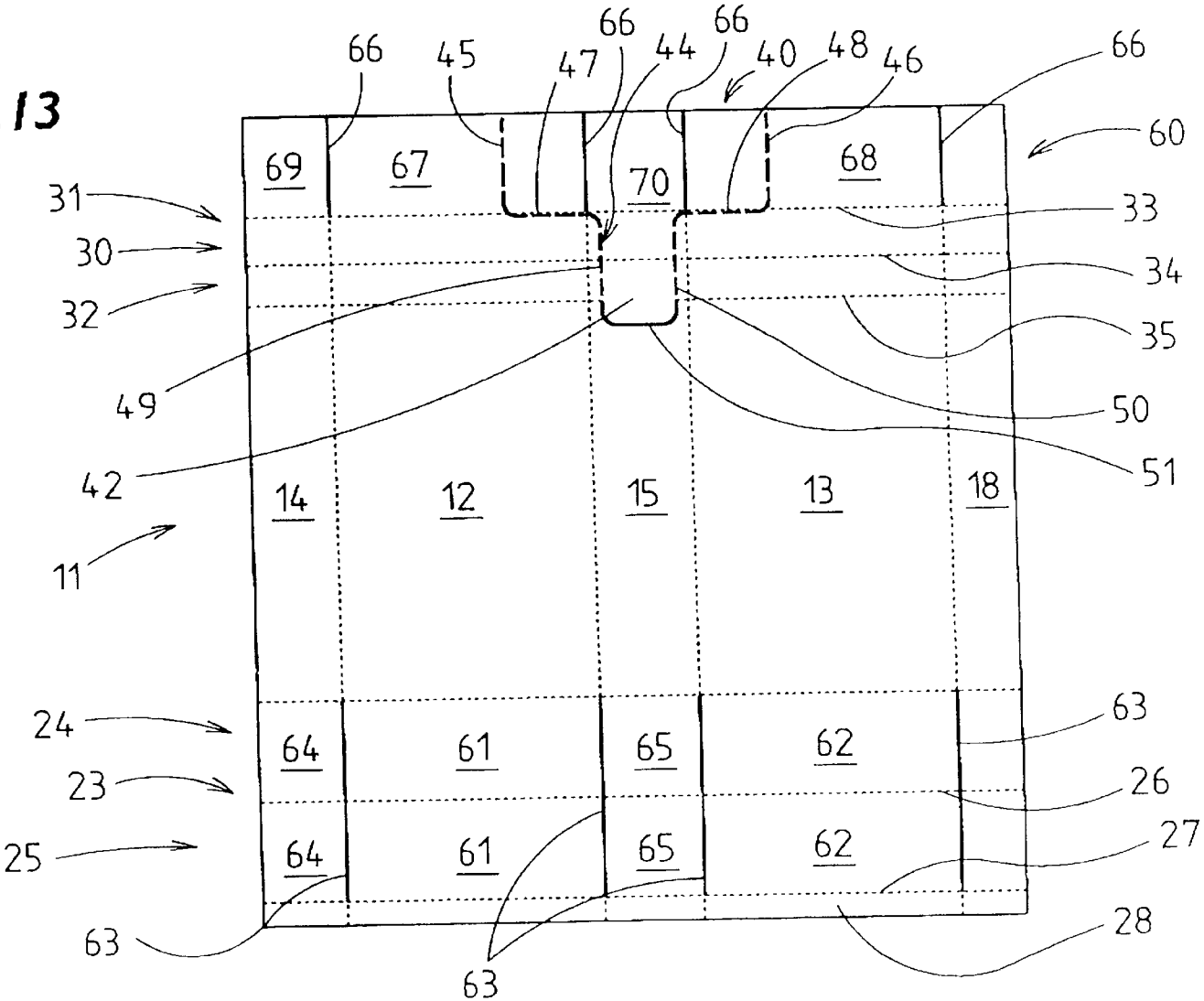
Figure 14:
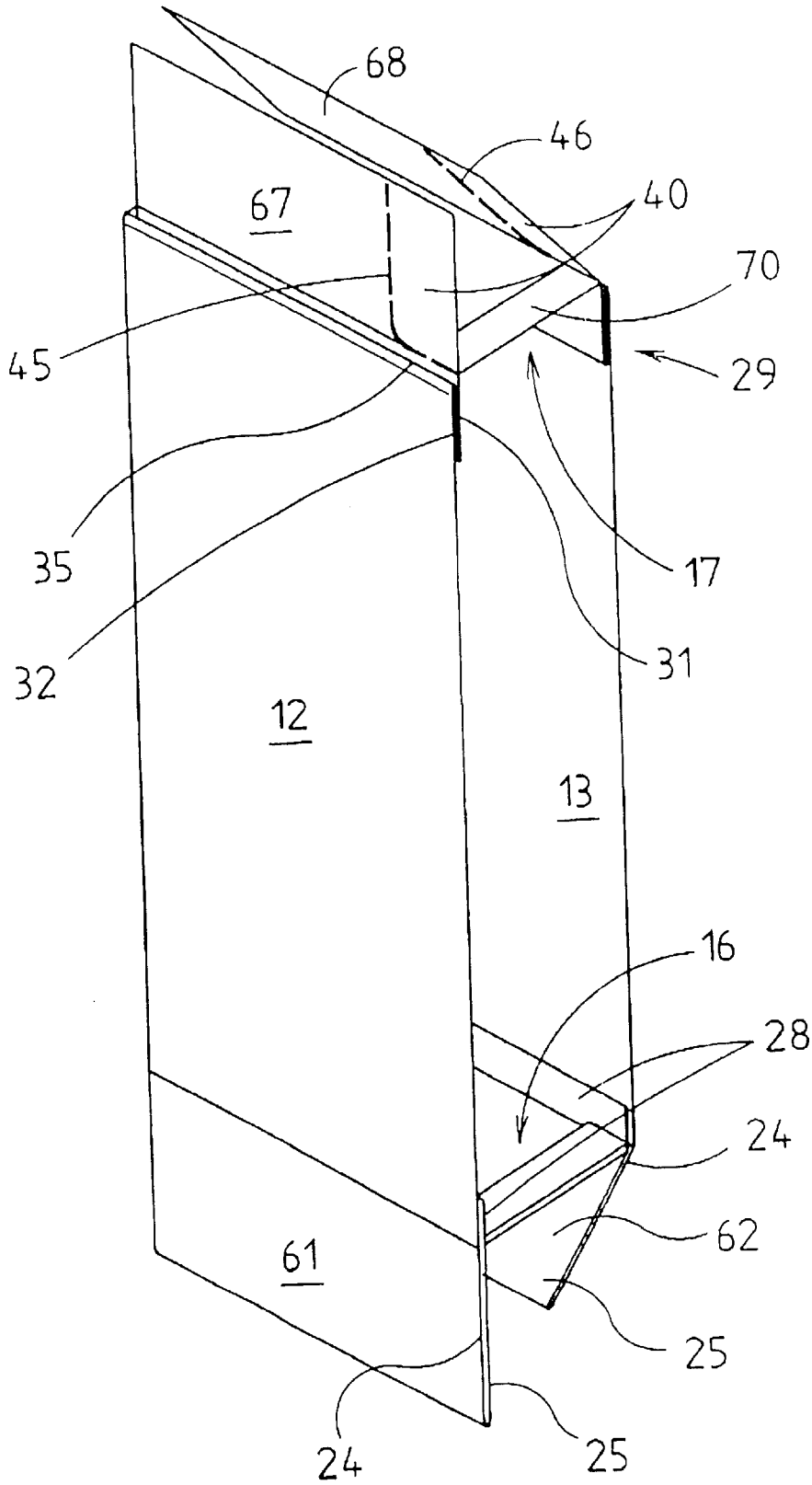

Exemplary embodiments of the (cigarette) packs according to the invention are explained in more detail hereinbelow with reference to the drawings, in which;

FIG. 1 shows a perspective illustration of a cigarette pack of the soft-carton type, FIG. 2 shows a schematic vertical section of a cigarette pack corresponding to FIG. 1, FIG. 3 shows, on an enlarged scale, the cigarette pack according to FIG. 1 in a plan view of an end wall, FIG. 4 shows a vertical section through a top corner region of the pack according to FIG. 3, the section being taken along a section line IV—IV, FIG. 5 shows a top corner region of a cigarette pack analogous to FIG. 1 with a (revenue-stamp) strip, FIG. 6 shows a cigarette pack according to FIG. 5 (with strip) in the open position, FIG. 7 shows, on an enlarged scale, a top corner region of the pack according to FIG. 6, FIG. 8 shows a spread-out blank for a cigarette pack according to FIG. 1, FIG. 9 shows the blank according to FIG. 8 in an intermediate folding position, FIG. 10. shows the cross section of the blank according to FIG. 9 in the region of a tear-open flap, FIG. 11 shows a perspective illustration of a cigarette pack with an outer wrapper made of film, FIG. 12 shows a likewise perspective illustration depicting one point in time during the production of a pack according to FIG. 11, FIG. 13 shows a spread-out blank for a pack according to FIGS. 11 and 12, and FIG. 14 shows a perspective illustration, in vertical section, of the pack according to FIGS. 11 and 12 before it has been finished off.

The preferred exemplary embodiments of cuboidal packs which are illustrated in the drawings are cigarette packs, to be precise those of the soft-carton type. With this type of pack, the pack contents, namely a group of cigarettes 10, are enclosed by a wrapper made of paper or similar, comparatively thin packaging material. The special feature of the present packs is that they comprise a single, one-piece, continuous blank 11. This blank is designed and/or folded so as to form a (cigarette) pack with a front wall 12, rear wall 13, two narrow, upright side walls 14, 15 and an integrally connected base wall 16 and end wall 17. That part of the pack which comprises the front wall 12, rear wall 13, side walls 14, 15 and base wall 16 is designed and arranged such. that, from the outside, it gives the impression of a conventional (soft) carton. The end wall 12 is made to look, by folding, as if it is separated off from the adjacent pack walls.

The blank 11 for a wrapper according to FIG. 1, is shown in the spread-out form, with fine dashed folding lines, in FIG. 8. The side wall 14, front wall 12, side wall 15 and rear wall 13 are positioned one after the other or one beside the other within the blank 11. Connected to the free side of the rear wall 13 is a connecting strip 18 which extends over the entire width of the blank 11. Said connecting strip butts against the inside of the side wall, 14 and is connected to the latter by adhesive bonding.

The base wall 16 comprises base folding tabs which, in this exemplary embodiment, are designed for envelope-type folding. This type of folding produces trapezoidal base longitudinal tabs 19 and 20, which partially overlap one another and are connected to one another by adhesive bonding in the overlapping region. The base longitudinal tabs 19, 20 are connected to the front wall 12, on the one hand, and to the rear wall 13, on the other hand. The side walls 14, 15 are likewise adjoined by trapezoidal folding tabs, namely base corner tabs 21 and 22 These are arranged on the inside, that is to say they are partially overlapped on the outside by the base longitudinal tabs 19, 20.

A special feature is that, in the region of the base wall 16, the pack is reinforced by a multi-layered design at least of the base folding tabs 19, 20, 21, 22. In the present exemplary embodiment, the base longitudinal tabs 19, 20 and the base corner tabs 21, 22 comprise two layers of the blank 11. These are formed by a corresponding region of the blank 11 being folded over. For this purpose, the blank 11 is dimensioned such that a continuous border strip 23 is formed in the region of the base wall 16. This border strip comprises two adjacent material strips 24, 25 which are separated from one another by a continuous folding line 26. The material strip 25 is adjoined at the free border, via a further folding line 27, by a reinforcing strip 28. When the base wall 16 has been folded definitively, said reinforcing strip extends, in an upright plane, around the inside of the front wall 12, rear wall 13 and the side walls 14, 15.

A further special feature is provided in the region of the transition of the carton-like pack part, comprising the front wall 12, rear wall 13 and side walls 14, 15, into the end wall 17. Here, an encircling, multi-layered fold of the blank 11, namely a Z-fold 29, is formed. This fold is defined within the blank 11 as folding strip 30. Two legs 31, 32 are separated off by folding lines 33, 34, 35. When the pack is in the finished state, the folding line 35 forms a top border of the carton part. The folding leg 32 is folded against the inside of the front wall 12, rear wall 13 and side walls 14, 15. The folding leg 31 is dimensioned to be wider than the folding leg 32 and thus projects beyond the folding line 35 and beyond the top border of the carton part. This folding leg 31 is adjoined by folding tabs of the end wall 17, namely trapezoidal end longitudinal tabs 36, 37 and likewise trapezoidal end corner tabs, 38, 39.

The multi-layered fold of the blank 13 in the region adjacent to the end wall 17, that is to say the Z-fold 29, makes it possible to provide a special opening aid for the pack. This opening aid comprises a tear-open flap 40 which is bounded by weakening lines, namely by perforation lines. The tear-open flap 40 extends at least partially in the region of the end wall and in the top region of an adjoining pack wall. In the present case, the tear-open flap 40 is arranged over the corner in a region of the end wall 17 which is directed towards the side wall 15, and in the region of said side wall 15 itself. Removal of the tear-open flap 40 exposes, in the end wall 17, a removal opening 41 for the cigarettes 10.

The tear-open flap 40 is provided with a grip tab 42. The latter is designed as a continuation or exposed part of the tear-open flap 40. When the pack has been folded definitively (e.g. FIG. 1), the grip tab 42 extends beyond the folding lines 35 from the top region of the side wall 15, By virtue of being folded over, the grip tab 42 is located on the outside of the pack and is fixed releasably there. In the example according to FIG. 1, border or corner regions of the grip tab 42 are pushed beneath folding tabs of the end wall 17, namely beneath the end longitudinal tabs 36, 37. In order to open the pack, the grip tab 42 is drawn out of this anchorage and can then be manipulated for the purpose of removing the tear-open flap 40. This exposes a removal opening 41 which, in the present case, extends over the entire width of the end wall 17 and is adjoined, in the region of the side wall 15, by a slightly narrower cutout 43.

The tear-open flap 40 is defined by a weakening line of the blank 11, namely by a perforation line 44. This is designed as a continuous line, starting and ending at a free border of the blank so as to bound a T-shaped region of the blank 11. In order to form a tear-open flap 40 according to FIG. 1, the perforation line 44 comprises two perforation legs 45, 46. These extend in the region of the end longitudinal tabs 36, 37, transversely with respect to the same. Said end longitudinal tabs are each adjoined by a transverse perforation 47, 48. This transverse perforation runs along the folding line 33. In the region of the side wall 15, a tongue-like part of the tear-open flap 40 is bounded by two side perforations 49, 50. These merge into a continuous, U-shaped punched line 51 for bounding the grip tab 42 in the region of the side wall 15. The punched line 51 extends up to the folding line 35, which simultaneously forms the top border of the carton part and the top border of the Z-fold 29. The folding line 35 ends at the grip tab 42, or at the punched line 51, while the folding lines 33 and 34 run through the tear-open flap 40.

When the blank 11 has been folded definitively, the perforation legs 45, 46 are located one above the other, to be precise by the corresponding overlapping of the end longitudinal tabs 36, 37. These perforation legs 45, 46 extend transversely over the end wall 17. The transverse perforations 47, 48 run on mutually opposite sides of the end wall 17, namely on the border thereof, with the result that the removal opening 41 can occupy the entire width of the end wall 17.

In the present case, the tear-open flap 40 comprises a top region of the side wall 15, said region being directed towards the end wall 17, and, in the region of the end wall 17, sub-regions of the end longitudinal tabs 36, 37 and the end corner tab 38. The latter is removed completely as part of the tear-open flap 40. In the region of the end longitudinal tabs 36, 37, the tear-open flap 40 extends up to a region at a distance from a centre plane, approximately up to the region of a transversely directed revenue-stamp strip which is conventional in packs of this type (FIG. 5).

In the production of packs according to FIG. 1, the blanks 11 are produced from a continuous material web, in which the blanks are lined up in a row one beside the other. The border strip 23 and the folding strip 30 run laterally. As a first step, the above-described punched lines for bounding the tear-open flap 40 and the grip tab 42 are provided in the correct position. Thereafter, as transportation continues, the material web is folded over in the region of the border strip 23, with the result that the material strips 24, 25 butt against one another (FIGS. 9 and 10). At the same time, the Z-fold 29 is produced in the region of the folding strip 30. In this folding process, that part of the tear-open flap 40 which is bounded by the punched line 51, namely the grip tab 42, is not folded over as well, rather, the grip tab 42 remains in the original position, namely in extension or continuation of the side wall 15. Accordingly, the grip tab 42 projects beyond the Z-fold 29 and beyond the folding line 35 (FIG. 10). After this, a blank 11 folded as in FIGS. 9 and 10 is detached from the material web.

The blank 11 prepared by partial folding in the manner of FIGS. 9 and 10 is processed in the same way as in the case of the production of conventional soft-carton packs. An example of a production process and apparatus can be gathered from DE 196 41 151.3. In any case, the blanks 11 are processed on folding mandrels of a folding turret. The base wall 16 is also folded in the region thereof.

For optimum configuration of the pack, regions and/or folding tabs are connected to one another by adhesive bonding. FIG. 8 shows an expedient arrangement of applications of glue on the blank 11. These applications of glue are spots of glue which are applied by glue nozzles, to be precise preferably during the transportation of the blanks 11 or of the material web for producing such blanks.

As FIG. 8 shows, the Z-fold 29 is fixed by gluing, namely by a number of spots of glue 52. The spots of glue 52 are arranged at a distance from one another in the region of the folding leg 32. The latter butts against the inside of the carton part. In each case two spots of glue 52 are provided in the region of the front wall 12 and rear wall 13. The spots of glue 52 are provided on the (printed) outside of the blank 11, which is directed upwards during the production of the blanks 11.

A transversely directed row of spots of glue 53 is located in the region of the connecting strip 18. These spots of glue 53 serve for connecting the connecting strip 18 to the inside of the side wall 14.

A further row of spots of glue 54 is located in the region of the border strip 53 [sic]. These spots of glue 54 too are arranged on the (printed) outside of the blank 11. They are located in the region of the material strip 24, to be precise on the inside of the outer base longitudinal tab 19, which is to be produced by appropriate folding. Said base longitudinal tab 19 is connected to the outside of the inner base longitudinal tab 20 via the spots of glue 54.

It is also the case that the folding tabs of the end wall 17, namely in particular the end longitudinal tabs 36, 37, are connected to one another by adhesive bonding. A row of spots of glue 55 is provided in the region of an end longitudinal tab 37. This is preferably the outer, end longitudinal tab 37, which is provided on the inside with the spots of glue 55.

The spots of glue 52, 53, 54 are expediently provided during folding of the blank 11 on a folding mandrel, that is to say in accordance with DE 196 41 151.3.

The pack s designed in the present manner may be formed without a revenue-stamp or closure strip in the region of the end wall 17. This applies, in particular, when the folding tabs of the end wall 17 are connected to one another by adhesive bonding.

However, it is also possible to provide a revenue-stamp strip 56 in the conventional manner. In this case, the tear-open flap 40 is arranged such that the transversely directed boundary, namely the perforation legs 45, 46, are located beneath the revenue-stamp strip 56, that is to say are concealed by the latter (FIG. 5).

A further alternative, however, is possible, namely one which involves the tear-open flap 40 being designed such that, once the removal opening 41 has been exposed, said flap remains connected to the end wall 17 This possibility is shown in FIGS. 6 and 7. In this case, the perforation line 44 does not have the perforation legs 45, 46 directed transversely with respect to the end surface.

If the grip tab 42 cannot, or is not to, be fixed by the folding tabs of the end wall 17, it is also possible for the projecting grip tab 42 to be fixed by an outer wrapper 57 made of clear film. This outer wrapper 57 usually encloses the pack on all sides. FIG. 12 shows a phase in which the outer wrapper 57 is being attached In the region of the end wall 17, the outer wrapper 57 is folded against the end wall 17. In this case, the grip tab 42 is folded over against the end wall 17 and held in this position by the outer wrapper 57 (FIG. 11). When the outer wrapper 57 is opened with the aid of a tear-open strip 58, the end wall 17 is exposed and the grip tab 42 can pass into a position in which it can be gripped.

The configuration of the pack described, in particular the opening aid described, permits a novel design of the (cigarette) packs of this type, namely the configuration of the base wall 16 and/or the end wall 17 by the label-folding principle A pack configuration of this type is shown in FIGS. 11 to 14.

The blank 11 is designed analogously to FIG. 8, namely with a border strip. 23 for forming a double-layered base wall 16. The border strip 23 comprises two material strips 24, 25, which nevertheless are each wider than in the exemplary embodiment according to FIG. 8.

Formed on the opposite side of the blank 11 is a folding strip 30 with folding legs 31, 32 for producing a Z-fold 29 A border-side blank strip 60 serves for forming the folding tabs of the end wall 17).

The folding tabs of the base wall 16 and of the end wall 17 are of special rectangular design and extend (approximately) over the entire surface area of the base wall 16 and end wall 17. For this purpose, the layers of double-layered base tabs 61, 62 are separated off from respectively adjacent corner tabs 64 and 65 by punch cuts 63. The punch cuts 63 extend over the entire width of the border strip 23, with the exception of the continuous reinforcing strip 28.

Once the border strip 23 has been folded along the folding line 26, this results in double-layered base tabs . 61, 62 which, with appropriate folding (FIG. 14), overlap one another over the entire surface area and are connected to one another by adhesive bonding. The corner tabs 64, 65, which are separated off from the base tabs 61, 62, are likewise of rectangular design and are the first to be folded into the plane of the base wall 16. The reinforcing strip 28 runs all the way around without interruption in the region of the upright pack walls.

Transversely directed punch cuts 66 are also provided in the region of the end wall, that is to say of the blank strip 60. These punch cuts 66 extend over the entire width of the blank strip 60 and, analogously to the configuration of the base wall 16, delimit end tabs 67, 68 and corner tabs 69, 70. The abovementioned folding tabs 67 . . . 70 are of rectangular design and are separated from one another. The end tabs 67, 68 extend over the entire surface area of the end wall 17.

The opening aid, namely the tear-open flap 40, is designed in the same way as in the abovedescribed exemplary embodiment of FIG. 8.

It is also possible for a revenue-stamp strip to be provided for this pack design, but it is preferably omitted.

A further special feature of the soft-carton pack comprising a one-piece blank 11 is illustrated in FIG. 2. A further material reinforcement is provided in the region of the base wall 16. The reinforcing strip 28, which runs around the upright walls (front wall 12, rear wall 13, side walls 14, 15), is provided with an additional reinforcement, to be precise by the virtue of a free border region being folded over so as to form an inner reinforcing leg 71. The latter is part of the blank 11 and is connected to the blank 11, or the reinforcing strip 28, via a folding line 72. The blank according to FIGS. 8 and 9 is correspondingly wider and provided with the additional folding line 72, parallel to the folding line 27. The reinforcing leg 71 forms, in the region of the base wall 16, a three-layered construction of the pack, analogous to the three-layered Z-fold

What is claimed is:

1. A pack made from a blank of folding packaging material, comprising a front wall (12), a rear wall (13), side walls (14, 15), a base wall (16), an end wall (17) delimited from adjacent ones of said side walls and a tear-open flap (40) with a grip tab (42), wherein:

a) arranged in a region below the end, wall (17) and adjacent thereto is a circumferential, multi-layered material strip (29) formed by a Z-fold in the packaging material, b) the Z-fold (29) is formed in a region of the grip tab (42) by an upper region of one of the side walls, by a middle folding leg (32) and an inner folding leg (31), c) the grip tab (42) is an exposed part of the Z-fold (29), namely of the one side wall as part of the Z-fold (29), and d) connected to the exposed grip tab (42) in an extension of the grip tab (42) are side perforations (49, 50) which extend in a region of the middle and inner folding legs (31, 32) up to the tear-open flap (40).

2. The pack according to claim 1, characterized in that said pack is a soft-carton pack in which said end wall is connected integrally by said Z-fold (29) to said front wall (12), said rear wall (13), and said side walls (14, 15), and wherein the grip tab (42), by being folded over, lies in a plane of the end wall (17) and is fixed there by being clamped firmly beneath end longitudinal folding tabs (36, 37) of the end wall (17).

3. The pack according to claim 1 or 2, characterized in that the tear-open flap (40), including the grip tab (42), extends in a sub-region of the end wall (17) and an adjoining sub-region of said one of the side walls.

4. The pack according to claim 2, characterized by a blank (11) which has at an edge thereof folding tabs (36, 37, 38, 39), for the formation of the end wall (17) and, adjoining said end wall, a folding strip (30) for the formation of the Z-fold (29), wherein the tear-open flap (40) is formed by a perforation line (44) in a region of the end longitudinal folding tabs (36, 37) of the end wall (17) and, adjoining the end wall, in a region of said one side wall (15).

5. The pack according to claim 4, characterized in that the perforation line (44) comprises respective perforation legs (45, 46) in regions of the end longitudinal folding tabs (36, 37) and transverse thereto, and also comprises transverse perforations (47, 48) which adjoin said perforation legs and run along a folding line (33) for delimiting the end wall (17) and along a further region for delimiting a tongue-like part of the tear-open flap (40) in a region of the one side wall (15).

6. The pack according to claim 4, characterized in that the grip tab (42) is bounded, as part of the tear-open flap (40), by a continuous punched line (51) which extends in the region of the one side wall (15) up to a folding line (35) for forming a folding edge of the Z-fold (29).

7. The pack according to claim 1, characterized in that folding tabs (36, 37) of the end wall (17) are connected to one another by adhesive bonding.

8. The pack according to claim 1, characterized in that the Z-fold (29) is fixed by adhesive bonding of folding legs (31, 32).

9. The pack according to claim 1, characterized in that folding tabs of the base wall (16) are connected to one another by adhesive bonding.

10. The pack according to claim 1, characterized in that the tear-open flap (40) remains connected to the end wall (17), even once a flap removal opening (41) has been exposed, the flap remaining connected by a perforation line (44) without perforation legs (45, 46) directed transversely with respect to the end wall (17).

11. The pack according to claim 1, characterized in that the base wall (16) and the end wall (17) are provided with rectangular base tabs (61, 62) and rectangular end tabs (67, 68), respectively, which extend over the entire surface area of the base wall (16) and end wall (17), respectively, and are connected to one another by adhesive bonding, wherein the base tabs (61, 62) and the end tabs (67, 68) are delimited from associated corner tabs (64, 65 or 69, 70) by punch cuts (63, 66).

12. The pack according to claim 1, characterized in that, in a region of the base wall (16), punch cuts (63) are arranged in a region of a border strip (23) for forming double-layered base tabs (61, 62) and corner tabs (64, 65).

13. The pack according to claim 1 characterized in that the grip tab (42), which projects freely in a region of the end wall (17), is fixed in abutment against the end wall (17) by an outer wrapper (57) made of film.

14. The pack according to claim 1, characterized in that arranged on an inside, adjacent to the base wall (16), in a region of the front wall (12), the rear wall (13) and the side walls (14, 15), is an inwardly folded reinforcing leg (71) of the blank (11), the reinforcing leg (71) being connected to a reinforcing strip (28) via a folding line (72).

* * * * *